US011448073B2

(12) United States Patent
Venugopal et al.

(10) Patent No.: US 11,448,073 B2
(45) Date of Patent: Sep. 20, 2022

(54) SYSTEM FOR CONTROLLING ADMISSION VOLUME OF INLET GAS FOR FIXED RPM OPERATION OF ROTARY OR RECIPROCATING EXPANDER

(71) Applicant: Indian Institute of Technology Madras (IIT Madras), Chennai (IN)

(72) Inventors: Vipin Venugopal, Alappuzha (IN); Satyanarayanan Seshadri, Chennai (IN)

(73) Assignee: Indian Institute of Technology, Madras (IIT Madras), Chennai (IN)

( * ) Notice: Subject to any disclaimer, the term of this patent is extended or adjusted under 35 U.S.C. 154(b) by 0 days.

(21) Appl. No.: 17/283,231

(22) PCT Filed: Oct. 3, 2019

(86) PCT No.: PCT/IN2019/050728
§ 371 (c)(1),
(2) Date: Apr. 6, 2021

(87) PCT Pub. No.: WO2020/075182
PCT Pub. Date: Apr. 16, 2020

(65) Prior Publication Data

US 2021/0381379 A1 Dec. 9, 2021

(30) Foreign Application Priority Data

Oct. 8, 2018 (IN) ..... 201841038051

(51) Int. Cl.
*F01C 1/34* (2006.01)
*F01C 21/00* (2006.01)
*F01C 21/18* (2006.01)

(52) U.S. Cl.
CPC ..... *F01C 21/18* (2013.01); *F01C 1/34* (2013.01); *F01C 2021/12* (2013.01); *F01C 2021/1643* (2013.01)

(58) Field of Classification Search
CPC ..... F01C 21/18; F01C 1/34; F01C 2021/12; F01C 2021/1643
USPC ..... 123/18 A, 18 R, 43 A, 45 A, 45 R, 123/200–249; 418/140, 187, 61.1
See application file for complete search history.

(56) References Cited

U.S. PATENT DOCUMENTS 3,847,514 A * 11/1974 Chen ..... F01C 21/18 418/15
4,047,856 A * 9/1977 Hoffman ..... F01C 1/22 418/61.2
4,507,066 A * 3/1985 Duffy ..... F01C 21/18 418/61.2

* cited by examiner

*Primary Examiner* — J. Todd Newton

(57) ABSTRACT

Accordingly, embodiments herein disclose a system (500) for controlling admission volume of an inlet gas for fixed RPM operation of in an apparatus. The system (500) has a boiler (502) for generating a steam at a higher pressure for heating application in a process. A pressure reducing valve (PRV) (504) controls a boiler pressure to process pressure. Inlet ports and exhaust ports are configured by intersection of opening on a rotor housing (614) and opening on a rotating valve. Inlet ports are configured so that a port opening duration can be controlled to admit required volume of a steam corresponding to a mass flow requirement of the process. A port capable of changing the area and timing of opening in such a way that the duration and starting of exhaust can be controlled.

9 Claims, 10 Drawing Sheets

| TABLE | | |
|---|---|---|
| S NO | DESCR PTION | QTY |
| 1 | GAMMER ASSLY | 04 |
| 2 | MTG BKT ASSLY 02 | 04 |
| 3 | GEAR SIDE COVER | 01 |
| 4 | REAR COVER ASSLY 01 | 04 |
| 5 | ROTOR HOUSING | 01 |
| 6 | BEARING | 24 |
| 7 | CIRCLIP 01 | 01 |
| 8 | SPOOL MECH ASSLY | 04 |
| 9 | PIN 01 | 16 |
| 10 | SPRING 01 | 04 |
| 11 | FLYWHEEL COVER | 01 |
| 12 | LIP01 | 04 |
| 13 | BOLT 01 | 18 |

SYSTEM FOR CONTROLLING ADMISSION VOLUME OF INLET GAS FOR FIXED RPM OPERATION OF ROTARY OR RECIPROCATING EXPANDER

FIELD OF INVENTION

The present disclosure relates to a volumetrically controlled expander, and more specifically related to a mechanism for controlling admission volume of inlet gas for a fixed revolutions per minute (RPM) operation of a rotary or reciprocating expander. The present application is based on, and claims priority from an International Application PCT/IN2019/050728 filed on 3, Oct. 2019 and an Indian Application Number 201841038051 filed on 8, Oct. 2018, the disclosure of which is hereby incorporated by reference herein.

BACKGROUND

Almost all process industries uses steam as its energy carrying medium since it is cheap, high heat transfer coefficient-particularly in a saturated zone, high latent heat of vaporization, and is inert. Due to process compulsions, to reduce boiler size and piping, steam generation normally happens at high pressure whereas usage happens at low pressure. The reduction of this pressure is done using a pressure reducing valve (PRV). The process in a PRV is isenthalpic and irreversible. This reduces the exergy of steam. Thermodynamically and economically it is better to expand the steam by extracting work from it. However isenthalpic expansion is practically difficult hence it is better to do isentropic expansion. The reduction in total enthalpy available to the process can be compensated by adding equivalent mass of extra steam to the inlet of expander. The economic implication will be limited to brake efficiency and additional mass flow of steam which is proportional to work done. This typically works out to be Rs1 to 1.2/KWH generated. The isentropic efficiency will not affect the generation cost since the outlet of the expander is going to process. However lower the isentropic efficiency lower the power generated and hence longer the return on investment.

Energy storage is another emerging application for volumetrically controlled expander. With decentralized power generation coupled with variation in power output due to unpredictable nature of renewable energy generation, the potential for power production and estimated usage never matches. This necessitates the need for energy storage to make the power production at its peak efficiency (economic and environmentally). Due to lack of energy storage during surplus availability wind turbines are parked, similarly in many industries peak demand is managed using diesel generators, which can create hole in both pocket and environment. These industries with variation in power requirement can store power during their low power usage period and use the stored energy to match the peak requirement.

Most of the commercially available expanders is not the optimal solution for either process industries or energy storage systems. In process industry the primary focus is on the process. The power generated by expander is secondary. The process load is not constant, it varies and hence the mass of steam that need to pass through the expander also varies. At present it is either done by throttling the inlet steam, reducing the inlet pressure to the expander and hence the mass flow or by under sizing the expander to the basic load of the plant and the variation in the load is met with a PRV in parallel to the expander. Even few technologies uses stepped control rather than a continuous control. In case of expansion of saturated steam, dynamic displacement machines like turbines are not suggested due to its well-known issues with wet steam. Hence a real requirement of continuously varying volumetrically controlled modular expansion device exists, which can dynamically change the admission volume of steam during a cycle, there by controlling the mass flow rate without changing the admission pressure to the expander.

In the case of energy storage, Storage of compressed air is normally done at constant volume rather than at constant pressure due to practical difficulties to store compressed air at constant pressure. Constant pressure storage would have enabled the expander to run at constant pressure ratio, enabling the designers to design the expander to run at constant pressure ratio, thereby achieving higher isentropic efficiency. But in constant volume systems, which is the typically used storage method, the expansion cannot happen at constant pressure. Here the pressure ratio changes drastically during the course of discharge of the compressed air storage tank. The present available technology cannot give high isentropic efficiency for the entire range of operation.

Thus, it is desired to address the above mentioned disadvantages or other shortcomings or at least provide a useful alternative.

SUMMARY

Accordingly embodiments herein disclose method and system for controlled volumetric expansion system for fixed rpm operation of a rotary or reciprocating expander.

In embodiment, volumetrically controlled expander for cogeneration and energy storage application, capable of handling the entire turndown range with variation in isentropic efficiency less than 10% from its peak isentropic efficiency of 85%. Dynamic volume control is the technique by which the variations required for mass flow rate can be achieved by dynamically adjusting the inlet volume of the expander. The pressure inside the cylinder at the end of expansion should be ideally equal to that of exhaust pressure, by controlling the admission volume. The proposed mechanism ensures this for the entire turndown.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF FIGURES

This method is illustrated in the accompanying drawings, throughout which like reference letters indicate corresponding parts in the various figures. The embodiments herein will be better understood from the following description with reference to the drawings, in which.

DETAILED DESCRIPTION OF INVENTION

Figure 1:
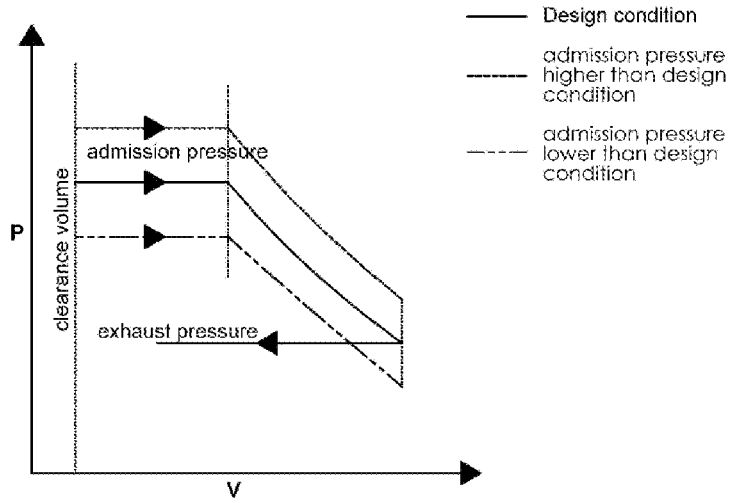
FIG. 1 illustrates a variation in expansion end pressure with change in admission pressure for expanders without dynamic admission volume control, according to an embodiment as disclosed herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. Also, the various embodiments described herein are not necessarily mutually exclusive, as some embodiments can be combined with one or more other embodiments to form new embodiments. The term "or" as used herein, refers to a non-exclusive or, unless otherwise indicated. The examples used herein are intended merely to facilitate an understanding of ways in which the embodiments herein can be practiced and to further enable those skilled in the art to practice the embodiments herein. Accordingly, the examples should not be construed as limiting the scope of the embodiments herein.

As is traditional in the field, embodiments may be described and illustrated in terms of blocks which carry out a described function or functions. These blocks, which may be referred to herein as units or modules or the like, are physically implemented by analog or digital circuits such as logic gates, integrated circuits, microprocessors, microcontrollers, memory circuits, passive electronic components, active electronic components, optical components, hardwired circuits, or the like, and may optionally be driven by firmware and software. The circuits may, for example, be embodied in one or more semiconductor chips, or on substrate supports such as printed circuit boards and the like. The circuits constituting a block may be implemented by dedicated hardware, or by a processor (e.g., one or more programmed microprocessors and associated circuitry), or by a combination of dedicated hardware to perform some functions of the block and a processor to perform other functions of the block. Each block of the embodiments may be physically separated into two or more interacting and discrete blocks without departing from the scope of the invention. Likewise, the blocks of the embodiments may be physically combined into more complex blocks without departing from the scope of the invention.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings. Although the terms first, second, etc. may be used herein to describe various elements, these elements should not be limited by these terms. These terms are generally only used to distinguish one element from another.

Accordingly embodiments herein achieve a method and system for Controlled volumetric expansion system for fixed rpm operation of a rotary or reciprocating expander.

Referring now to the drawings, and more particularly to FIGS. 1 through 14, there are shown preferred embodiments.

Figure 2:
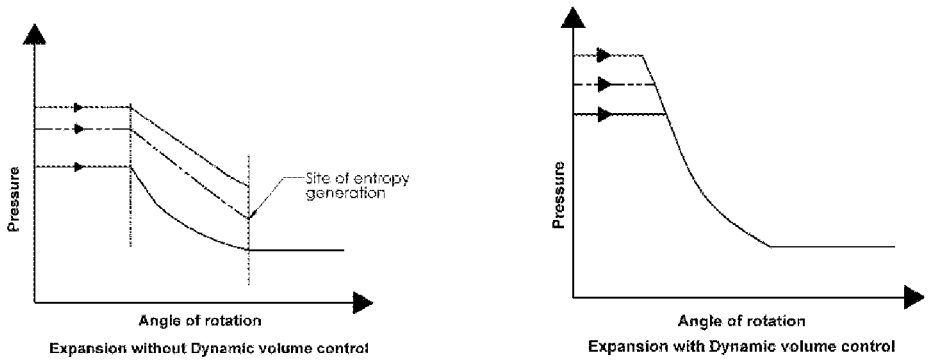
FIG. 2 illustrates a Pressure v/s Angle of rotation, showing dynamic admission volume control for energy storage application, according to an embodiment as disclosed herein.

FIG. 1 illustrates a variation in expansion end pressure with change in admission pressure. FIG. 2 illustrates a Pressure v/s angle of rotation, showing dynamic admission volume control for energy storage application.

The pressure inside the cylinder at the end of expansion should be ideally equal to that of exhaust pressure. For an expander having fixed geometric parameters the above mentioned condition can be achieved only for a specific pressure ratio. The above condition means achieving ideal conditions—expansion end pressure equal to process pressure and compression end pressure equal to admission pressure. If the pressure ratio goes above or below that value then the expansion end pressure will as like shown below in FIG. 1, FIG. 2 and FIG. 3. The pressure ratio is the ratio between boiler pressure and process pressure in absolute terms, here the boiler pressure is admission pressure to expander and the process pressure is exhaust pressure.

In process industries, the load is variable, so when the production demand goes down the expander should reduce the mass flow rate of steam through it. For a machine running at constant rpm with fixed volume of steam admission per cycle, this is possible only by reducing the density of the admission steam. The variation in admission pressure to vary the mass flow rate will lead to expansion end pressure to be either higher than exhaust pressure or lower. As soon as the port opens this leads to either inflow or outflow from the port. This is irreversible and generates entropy. Almost all present expander uses the above mode for governing. This is achieved by throttling the steam prior to admission.

Disadvantages of throttle governing is as follows:

i. Entropy generation due to throttling, this happens outside an engine.

ii. Expansion end pressure higher than exhaust pressure lead to entropy generation due to mixing.

iii. Expansion end pressure lower than exhaust pressure leads to entropy generation and valve chatter in cam controlled recip expander.

iv. Entropy generation due to variation in compression end pressure and admission pressure.

v. In order to avoid valve chatter, an allowance for part loading is done by setting expansion end pressure to be higher than exhaust pressure. This value is set based on the extent of part loading required. This is done to ensure that during part loading the expansion end pressure does not fall below exhaust pressure.

Further, the dynamic admission volume control is the technique by which the variations required for mass flow rate can be achieved by dynamically adjusting the inlet volume of the expander. The main advantages of dynamic admission volume control over throttle governing is as follows, i. Higher part load efficiencies, the variation in isentropic efficiency in the entire range of operation can be within 10%. The pressure v/s rotation angle of Wankel expander demonstrates this.

The various notations represent loading of the expander at three different pressures. In first case in the FIG. 2, other than the cycle drawn in solid (non dashed) line all others leads to entropy generation. Where as in second case the inlet volume of all cycle is so adjusted that the expansion curve of all the cycle lies on the same curve. This can be achieved by varying the inlet port dynamically. The above method is applicable for expanders used for energy storage application where compressed air in a pressurized tank is allowed to expand isentropically. During each cycle depending on the mass expanded the pressure in the tank keeps dropping. During this if the inlet volume of the expander remains constant, it leads to variation in expansion end pressure compared to ideal exhaust pressure.

Figure 3:
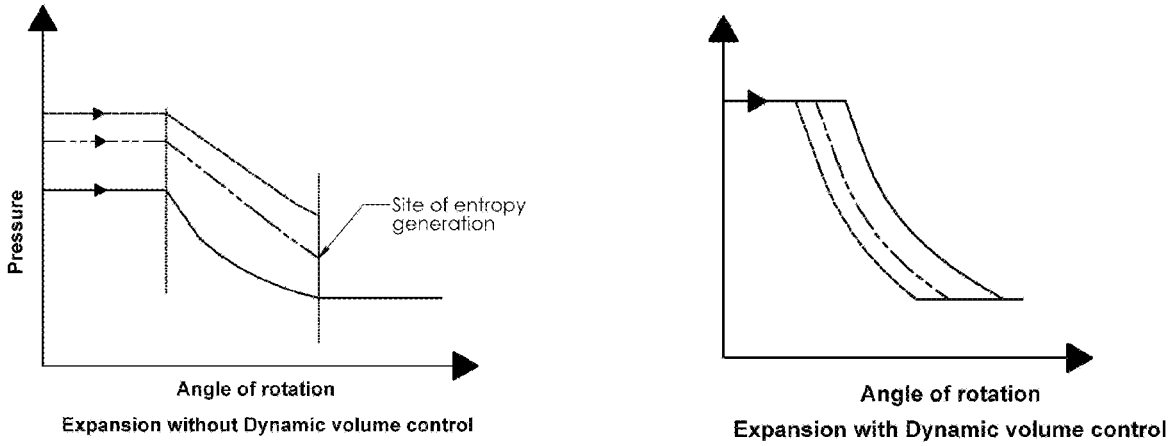
FIG. 3 illustrates Pressure v/s Angle of rotation, showing dynamic admission volume control, in process industries, according to an embodiment as disclosed herein.

FIG. 3 illustrates pressure v/s Angle of rotation, showing dynamic admission volume control, in process industries, according to an embodiment as disclosed herein.

In embodiment, dynamic control of cut-off volume (e.g., admission volume, or the like) is done to control the mass flow. The second figure in the FIG. 3, pressure v/s angle of rotation is applicable. The control can be achieved by dynamically controlling both inlet and exhaust port. The above mentioned technology intervention not only increases the power output by increase in isentropic efficiency but also increase power by avoiding throttling ahead of admission hence increasing the pressure ratio during part loading. Below are the advantages of the proposed system:

1. Increase in peak isentropic efficiency as mentioned earlier.
2. Can avoid using expensive control valve for throttling.
3. Increase in totalised power output.

Figure 4:
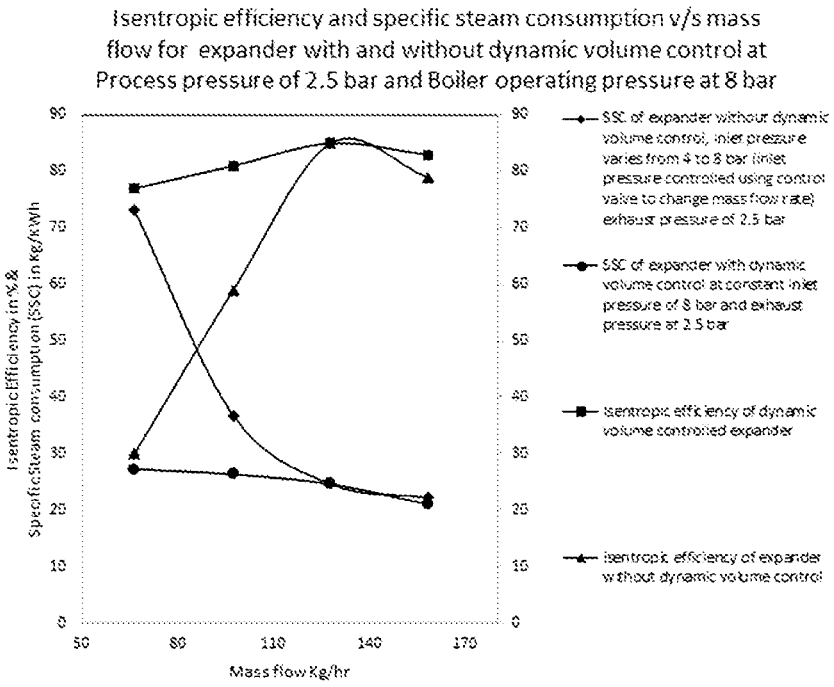
FIG. 4 illustrates performance of an expander with and without admission volume control, according to an embodiment as disclosed herein.

The FIG. 4 is graph showing isentropic efficiency & Specific steam consumption-SSC (mass of steam required for generating 1 KWh of power). Of expander with and without dynamic admission and exhaust control. Frictional power of 12.5 percent and induction generator efficiency of 95% assumed.

Figure 5:
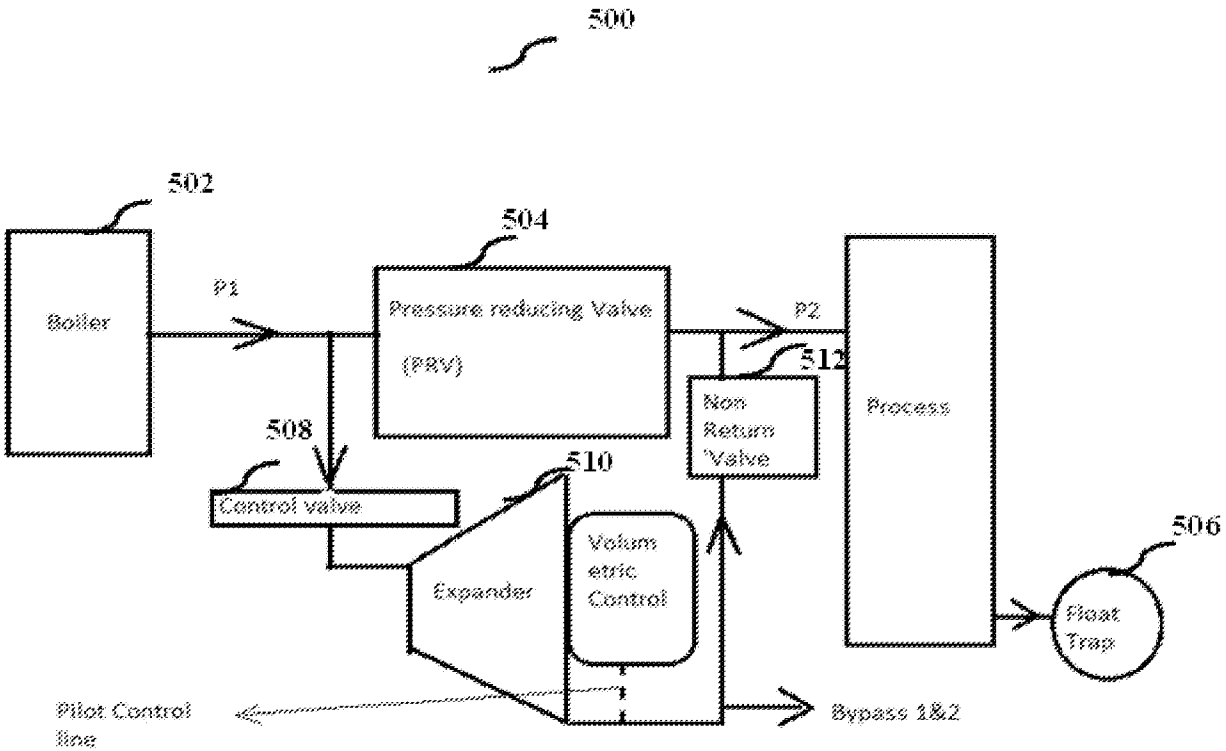
FIG. 5 is a schematic view of a system for controlling admission volume of an inlet gas for fixed RPM operation in an apparatus, according to an embodiment as disclosed herein.

FIG. 5 is a schematic view of a system (500) for controlling admission volume of an inlet gas for fixed RPM operation in an apparatus, according to an embodiment as disclosed herein. In an embodiment, the apparatus can be a rotary expander and a reciprocating expander. In an embodiment, the system (500) includes a boiler (502), a pressure reducing valve (PRV) (504), a float trap (506), a control valve (508), an expander (510) and a non-return valve (512). The boiler (502) generates a steam at a higher pressure for heating application in a process. The process can be any industrial process. The PRV (504) controls a boiler pressure to process pressure. Exhaust ports are placed on exhaust valves (610*a* and 610*b*), wherein inlet ports placed on the inlet valves (606*a* and 606*b*) and the exhaust ports are configured by intersection of opening on a rotor housing (614) and opening on a rotating valve. The inlet ports are designed in such a way that a port opening duration is controlled to admit required volume of a steam corresponding to a mass flow requirement of the process. A port capable of changing an area and timing of opening in such a way that the duration and starting of exhaust is controlled.

Figure 6:
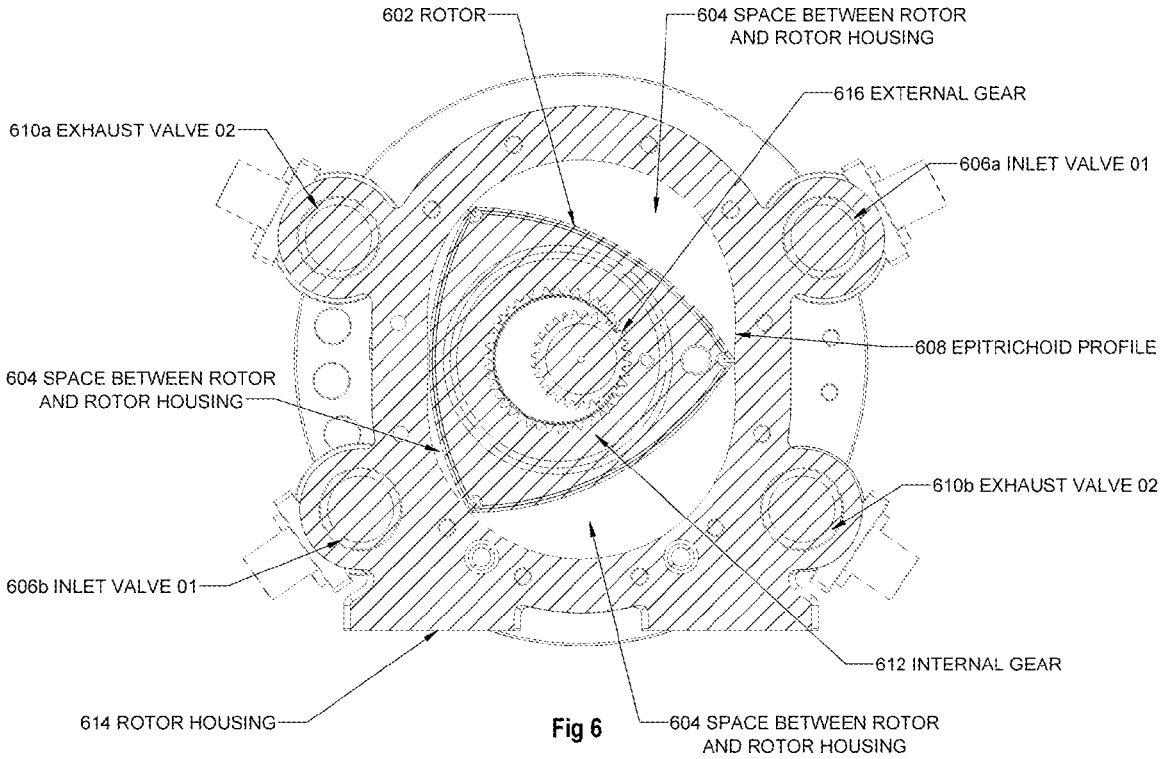
FIG. 6 is a cross section of wankel expander depicting different components, according to an embodiment as disclosed herein.

FIG. 6 illustrates an eccentric rotor (602), according to an embodiment as disclosed herein.

In an embodiment, the eccentric rotor (602) is held by a central shaft (626) supported by two bearings (618*a* & 618*c*) (i.e., first bearing and second bearing on two covers on either sides of a rotor housing (614). the rotor (602) can rotate independently on the shaft (626) over a third bearing. The motion of rotor (602), is constrained along an epitrochoid profile (608) with the help of stationary gear (external gear) (616) mounted on a gear-side cover (not shown) and an internal gear (612) mounted in the rotor (602). The steam supplied through the steam supply plate (628) passes through a port opening (630) in the valve and enters the space between the rotor (602) and the rotor housing (614). The motive power of steam pushes the rotor (602) and hence the shaft (626) to move in epitrochoid and rotational motion respectively. The power hence produced is drawn from the shaft (626). The supply of steam is done through two inlet valves (606*a* and 606*b*) for a stipulated period of time so that the admitted steam further under goes expansion inside a rotor housing space (604). Ideally the pressure at the end of expansion has to be equal to the back pressure available in exhaust valve line (normally the process pressure). The volume at which the admission of steam is stopped to allow expansion is called cut off volume. Similarly the spend steam has to be taken away from the rotor (602) and the rotor housing space (604). This is achieved with the help of two exhaust valves (610*a* and 610*b*). In order to reduce entropy generation the steam in the clearance volume at the end of the cycle need to be at a pressure and temperature equal to that of admission steam. To achieve this, the exhaust is stopped before end of cycle to allow residual mass to compress to admission pressure. The inlet valves (606*a* and 606*b*) and exhaust valves (610*a* and 610*b*) rotate synchronous with the central shaft (626) with the help of a timing belt/gear drive. The above mentioned cycle is as shown in the FIG. 12. Admission pressure considered here is 10 bar with a process pressure of 3 bar, which is most common pressure scenario in most process industries.

Any positive displacement machine is designed to run at constant rpm can deliver only a fixed mass flow to the process (e.g., Pasteurization in dairy, paper making, heating application in pharma industry, heating application in breweries related process or the like) for a given admission pressure. But most process the steam load varies. The variation in steam flow requirement is achieved in all positive displacement machine by throttling the admission steam pressure to reduce the density hence the mass flow rate, throttling is required since these machines cannot change the cut off volume. The above scenario leads to the conditions shown in the FIG. 13.

Figure 12:
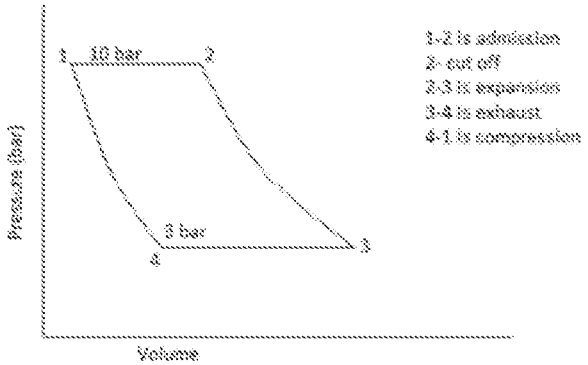
FIG. 12 is an example graph indicating ideal expansion cycle.
Figure 13:
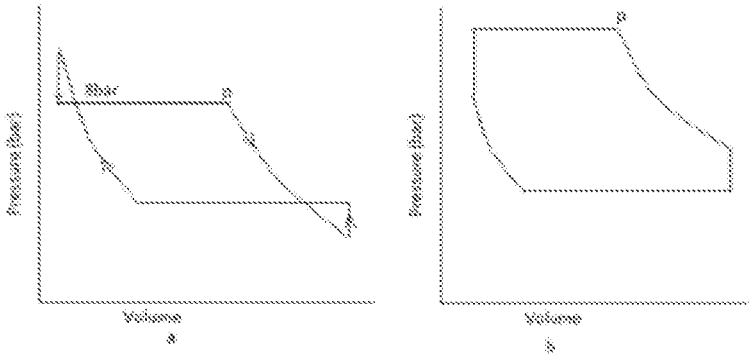
FIG. 13 is an example graph indicating conditions when admission pressure if lower/higher than design conditions.

The condition in the FIG. 13 is not desirable in most expanders, hence designers usually target an indicator diagram as shown in the notation of "b" of the FIG. 13 rather than the FIG. 12 to counter problem faced in notation of the "a" of the FIG. 13. This leads to entropy generation and compromises isentropic efficiency as shown in the FIG. 4. The main problem with machines with no dynamic control of admission volume is their incapability to change the volume corresponding to point p in diagram the notation "a" and "b" of the FIG. 13.

From the above discussion it is clear that the throttle governing in expanders leads to isentropic efficiency loss due to the following:

1. Irreversible mixing at the end of expansion when expanded steam mixes with the process steam at a pressure higher or lower than the process pressure,
2. Irreversible mixing of residual compressed steam in clearance volume with admission steam, and
3. Throttling of steam prior to admission to control the mass flow rate in order to meet the process requirement. This normally is done outside the expander using a pressure reducing valve.

Rather than compromising on design, and throttling the steam prior to admission it is better to develop a mechanism by which the admission volume of the expander can be changed as per the process requirement. This leads to indicator diagram as shown in FIG. 14.

Figure 14:
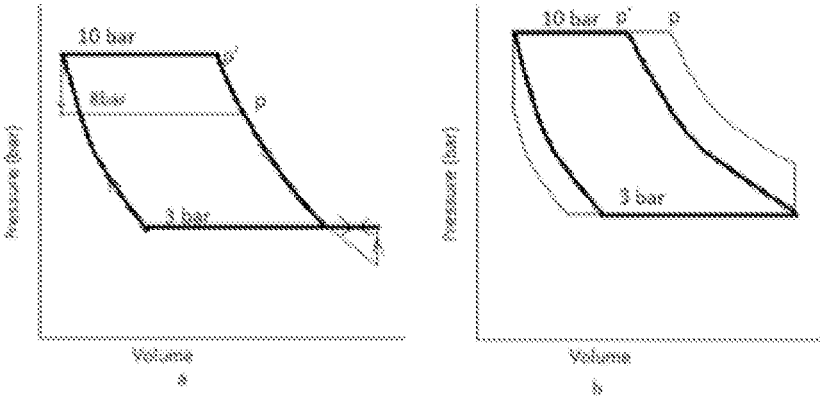
FIG. 14 is an example graph indicating an expander capable of dynamically varying the admission volume while in operation, according to an embodiment as disclosed herein.

The darker line superimposed on the FIG. 13 in the FIG. 14 shows the indicator diagram of expander capable of dynamically varying the admission volume while in operation. This lead to admission happening at same inlet pressure. No need of reducing the inlet pressure to reduce the mass flow, the mass flow is changed by reducing the admission volume by shifting p to p' in the notation "a" of the FIG. 14. The compromise of cut off in the notation "b" of 13 is done in order to reduce the difference between expansion end pressure and process pressure in the notation "a" of the FIG. 13, since in notation "a" of the 14 the problem is addressed, the indicator diagram in condition similar to the notation "b" of FIG. 13 changes to one shown in dark color in the notation "b" of FIG. 14.

The valve is designed capable of changing the admission volume dynamically during operation. Similarly exhaust valve is also design capable of advancing the exhaust timing and capable of controlling the start of compression by controlling the extend of exhaust.

The pilot steam line given in the back of the valve (as shown in the FIG. 10) makes the valve to move based on the process mass flow requirement. When the mass flow required is lower for the process the process pressure tends to increase. A small increase in that pressure moves the valve forward, the timing pulleys/gears stays in place since it slides on the spline on the valve, the axial locking of pulleys/gears are done using thrust faces. The movement of valve shows port profile on the valve with reduced duration of admission, the representative development drawing of inlet valve is as shown in the FIG. 11*a*, this reduces the mass flow rate by reducing the cut off volume. The spring connected to the valve thrust face gets compressed during the forward movement of the valve.

The reduction in cut off volume makes the expansion end pressure to reach process back pressure (refer notation "a" of the FIG. 14) prior to reaching the maximum volume in the space between rotor and rotor housing (614). Simultaneously the pilot process line given at the back of the exhaust valve (610) moves the exhaust valve (610) to advance the start of exhaust. The duration of the exhaust is also increased so as to maintain the same starting point of compression.

As soon as the mass flow requirement of the process increases, the process pressure drops making the valve to go back to required position using the energy stored in a spring.

Figure 10:
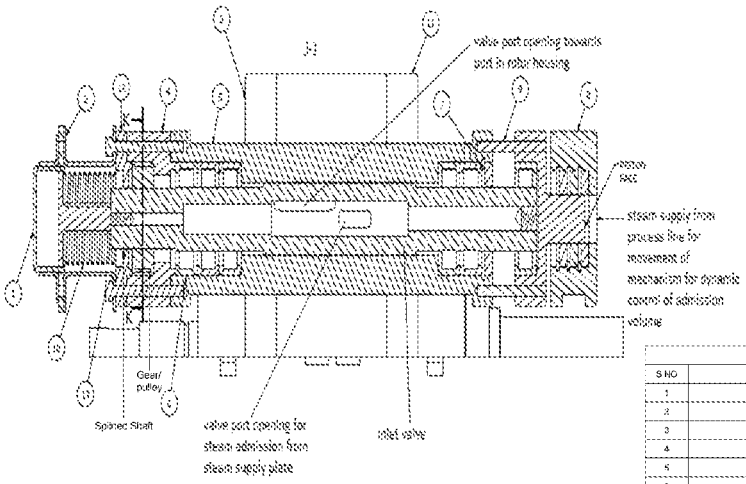
FIG. 10 is a main section showing the mechanism for dynamic control of admission of steam, according to an embodiment as disclosed herein.

As shown in the FIG. 10, a damper assembly (1), a MTG BKT (mounting bracket) assembly (2), gear side cover (3), rear cover assembly (4), a rotor housing (5), a bearing (6), a cir-clip (7), spool assembly (8), a pin (9), a spring (10), a flywheel cover (11), lid (12), and bolt (13) are provided. The damper assembly (1) is provided with the MTG BKT assembly (2), the gear side cover (3), the rear cover assembly (4), the rotor housing (5), the bearing (6), the cir-clip (7), the spool assembly (8), the pin (9), the spring (10), the flywheel cover (11), the lid (12), and the bolt (13).

The eccentric rotor (602) traces a closed profile such as an epitrochoid is used for expansion space in the apparatus. The rotor (602) has three faces each face completes one cycle in 180° motion of rotor, making six such cycles for all faces together in 360° motion of the rotor (602). Each cycle comprises of admission, expansion exhaust and compression. For 120° motion of the rotor (602), the central shaft (626) rotates by 360°. The two sets of inlet valves (606*a* and 606*b*) and the exhaust valves (610*a* and 610*b*) are synchronized in 1:1 ratio with central shaft (626) enabling it to control the admission, expansion, exhaust and compression of each face of rotor (602).

Admission happens through two admission ports inside the rotor housing (614). Rotor housing ports are fed by a rotary valve which is timed and profiled in such a way that it opens the port ways only for a stipulated period of opening as required by the admission process.

Similarly two exhaust ports and valves are present. The duration of the admission is controlled by an inclined port profile generated using combination of sine, cosine, polynomial, exponential functions on the valve, which increases or decreases the duration of admission of a working fluid to the expansion space. Different functions (sine, cosine, polynomial . . . ) mentioned is used to profile the port. The selection of one or more of these functions is based on the flow requirement and response time required for the process. These functions can be used in combination to make the port geometry on both valve as well as rotor housing. The working fluid can be steam, air, refrigerants.

The required profile for variation gets opened due to the movement of inlet valve through a spool arrangement which enables the translation motion of the valve.

The actuation of the spool is done by the process pressure in case of process industries and supply pressure in case of energy storage application. The actuation can be through direct mechanical linkages or pneumatic or electronically controlled.

The port designed in such a way that the process pressure and valve profile match to the instantaneous mass flow requirement.

Similar dynamic volume control is done on exhaust valve (610*a* and 610*b*) there by controlling the extent of exhaust, it's starting and indirectly controlling the extent of compression.

The timing pulley of the valve train is mounted on a spline enabling it to stay in its initial assembled position with the help of thrust faces.

dynamic admission/exhaust volume control of both inlet and exhaust is required for process industries where as for energy storage dynamic volume control is required only for only or alone admission.

Figure 11A:
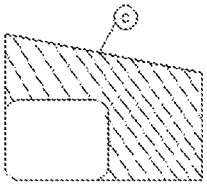
FIG. 11*a* indicates that a shaded area is a development drawing (actual surface is on cylindrical face of valve) of inlet port on inlet valve, non-shaded surface is the intersection of port surface on rotor housing and valve, according to an embodiment as disclosed herein.

FIG. 11*a* indicates that a shaded area is the development drawing (actual surface is on cylindrical face of valve) of inlet port on inlet valve, non-shaded surface is the intersection of port surface on rotor housing and valve.

Figure 11B:
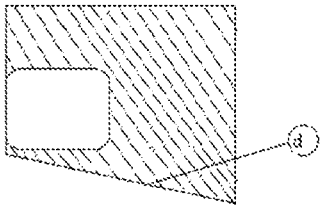
FIG. 11*b* indicates that shaded area is the development drawing (actual surface is on cylindrical face of valve) of exhaust port on exhaust valve, and the non-shaded surface is the intersection of port surface on the rotor housing, according to an embodiment as disclosed herein.

FIG. 11*b* indicates that shaded area is the development drawing (actual surface is on cylindrical face of valve) of exhaust port on exhaust valve, and the non-shaded surface is the intersection of port surface on the rotor housing.

Figure 7:
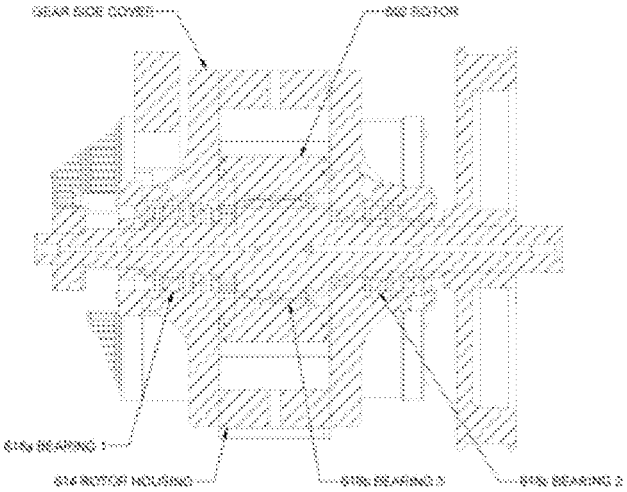
FIG. 7 is a sectional view illustrating a central shaft arrangement, according to an embodiment as disclosed herein.
Figure 8:
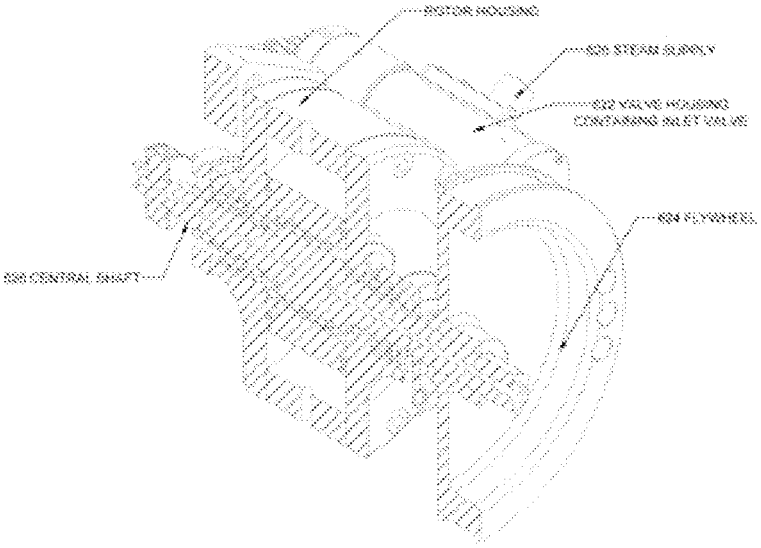
FIG. 8 is a sectional view illustrating a center section of a central shaft, according to an embodiment as disclosed herein.
Figure 9:
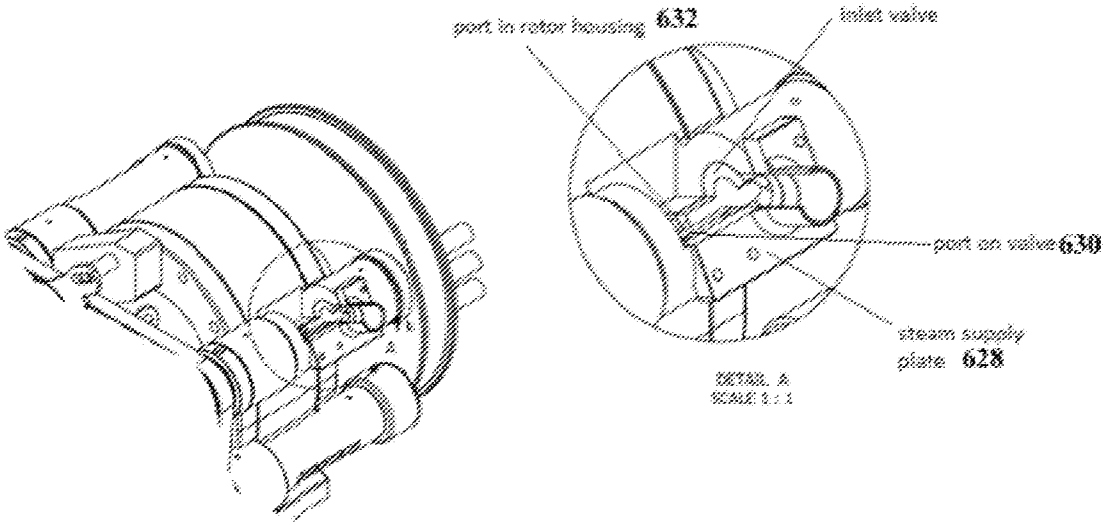
FIG. 9 is a sectional view illustrating admission steam path, according to an embodiment as disclosed herein.

FIG. 7 shows a section view of the central shaft. FIG. 8 is an isometric section view depicting various components in the rotor. FIG. 9 illustrates a steam flow path for rotor rotation.

The embodiments disclosed herein can be implemented using at least one software program running on at least one hardware device and performing network management functions to control the elements.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

We claim:

1. A system (500) for controlling admission volume of an inlet gas for fixed RPM operation in an apparatus, comprising:

a pressure reducing valve PRV) (504) for controlling a boiler pressure to a process pressure;

a boiler (502) for generating a steam for heating application in a process, wherein the pressure of the stream is higher than process pressure;

two inlets valves (606*a* and 606*b*);

two exhaust valves (610*a* and 610*b*), wherein the inlet valves (606*a* and 606*b*) and the exhaust valves (610*a* and 610*b*) are configured by intersection of opening on a rotor housing (614) ports and opening on a rotating valve, wherein the inlet valves are designed in such a way that a valve opening duration is controlled to admit required volume of a steam corresponding to a mass flow requirement of the process, wherein the valve capable of changing duration and timing of opening in such a way that the duration and starting of exhaust is controlled;

wherein the rotating valve is timed and profiled in such a way that the rotating valve opens the rotor housing ports only for a stipulated period which can be dynamically varied based on mass flow requirement of the process.

2. The system (500) of claim 1, wherein the system (500) further comprises an eccentric rotor (602) traces a closed profile such as an epitrochoid is used for expansion space in the apparatus.

3. The system (500) of claim 1, wherein a profile for variation gets opened due to the movement of the inlet valves (606*a* and 606*b*) and the exhaust valves (610*a* and 610*b*) through a spline arrangement which enables the translation motion of the valve.

4. The system (500) of claim 1, wherein the actuation of the spool arrangement is done by the process pressure or supply pressure, wherein the actuation is through direct mechanical linkages or pneumatic or electronically controlled.

5. The system (500) of claim 1, wherein the system further comprises a timing pulley or a gear of a valve train is mounted on a spline enabling it to stay in its initial assembled position using thrust faces.

6. The system (500) of claim 1, wherein the apparatus is a rotary expander and a reciprocating expander.

7. The system (500) of claim 1, wherein the system (500) dynamically varies a volume of admission steam to an expansion chamber during a cycle.

8. The system (500) of claim 7, wherein the cycle is an admission cycle, an expansion cycle, an exhaust cycle and a compression cycle.

9. The system (500) of claim 8, wherein the duration of the admission cycle is controlled by an inclined port profile generated using combination of sine, cosine, polynomial, exponential functions on the valve depending on the response time required for mass flow variation in process.

* * * * *